US005657650A

United States Patent [19]

Lee et al.

[11] Patent Number: 5,657,650

[45] Date of Patent: Aug. 19, 1997

[54] WASHING MACHINE HAVING A SPRAYING NOZZLE ASSEMBLY

[75] Inventors: Seung-Jun Lee, Buk-ku; Chung-sik Jung, Seo-ku, both of Rep. of Korea

[73] Assignee: Daewoo Electronics Co., Ltd., Seoul, Rep. of Korea

[21] Appl. No.: 558,660

[22] Filed: Nov. 16, 1995

[30] Foreign Application Priority Data

Apr. 29, 1995 [KR] Rep. of Korea ..... UM95-9050 U

[51] Int. Cl.[6] ..... D06F 39/08

[52] U.S. Cl. ..... 68/23.5; 68/207

[58] Field of Search ..... 68/23.5, 207

[56] References Cited

U.S. PATENT DOCUMENTS

| | | | |
|---|---|---|---|
| 2,885,879 | 5/1959 | Bloom | 68/207 |
| 2,972,876 | 2/1961 | Geldhof | 68/207 X |
| 3,335,584 | 8/1967 | Urban | 68/207 |
| 5,092,141 | 3/1992 | Quinn | 68/207 X |
| 5,285,664 | 2/1994 | Chang et al. | 68/207 X |

*Primary Examiner*—Philip R. Coe

*Attorney, Agent, or Firm*—Beveridge, DeGrandi, Weilacher & Young LLP

[57] ABSTRACT

A washing machine having a spraying nozzle assembly which not only sprays the circulated washing liquid onto the clothing evenly, but also completely removes impurities formed between an outer tub and a spin tub is disclosed. The spraying nozzle assembly has an upper frame and a lower frame secured to the upper frame. The lower frame has a plurality of spraying nozzles at its underside. Each spraying nozzle is circumferentially spaced apart from each other. Each spraying nozzle extends toward the upper inner wall of the spin tub so that impurities such as foam formed between the spin tub and the outer tub can be completely removed without wasting any washing liquid.

18 Claims, 5 Drawing Sheets

WASHING MACHINE HAVING A SPRAYING NOZZLE ASSEMBLY

BACKGROUND OF THE INVENTION

1. Field of the Invention

The present invention relates to a washing machine, and more particularly to a washing machine having a spraying nozzle assembly which can evenly spray washing liquid circulated through a circulation pump onto the objects being washed.

2. Prior Arts

A washing machine is an appliance for separating dirt from objects being washed such as clothing by sequentially carrying out various cycles in the order of water feeding, washing, rinsing, dehydrating, and draining cycles.

While the above cycles are executed, dirt contained in the clothing separates from the clothing by means of a detergent or friction between the washing liquid and the clothing.

However, in conventional washing machines, the detergent particles can not completely dissolve in the washing liquid so that some of the detergent particles remain between a spin tub and an outer tub in its solid state. For this reason, the dirt can not easily separate from the clothing and a large quantity of detergent is required for properly cleaning the clothing.

Further, conventional washing machines repeat the water feeding and draining cycles several times in order to carry out the washing and rinsing cycles so that washing machines unnecessarily waste the washing liquid.

In order to overcome the above problems, various types of conventional washing machines have been proposed. One of the proposed washing machines is disclosed in U.S. Pat. No. 5,285,664.

FIG. 6 shows the conventional washing machine disclosed in U.S. Pat. No. 5,285,664.

As shown in FIG. 6, a washing machine 500 comprises a housing 12 having a control panel 11 at its upper portion, an outer tub 15 disposed in housing 12 so as to receive the washing liquid, a spin tub 512 accommodated in outer tub 15 and formed at its side wall with a plurality of through holes 511, a motor 17 which generates a driving force for operating the washing machine 500, a power transmission 540 for transmitting the driving force from motor 17 to spin tub 512 and a circulation pump 525 disposed at the bottom of housing 12 so as to communicate with outer tub 15. Circulation pump 525 circulates the washing liquid through a circulation tube 521 into an adapter 520 or drains the washing liquid through a drain tube 533 into the exterior of the washing machine 500, alternatively.

Power transmission 540 includes a rotating shaft 542 connected to motor 17 through a belt 18 so as to receive the driving force from motor 17, a gear and link assembly 544 for rotating an agitator 548 mounted on the bottom wall of spin tub 512 in the forward and reversed directions in accordance with predetermined cycles and a connection member 546 for connecting agitator 548 to gear and link assembly 544.

A removable lid 515 having a sprinkling guide surface 516 is mounted on the upper portion of outer tub 15, and is provided at its underside with an annular guide member 514 having a discharge silt 513. In addition, a sprinkling nozzle 518 is formed between annular guide member 514 and removable lid 515 so as to spray the washing liquid to spin tub 512.

On the other hand, circulation pump 525 has a rotating shaft 528 which is integrally formed at its one end with a pulley 529. Pulley 529 of circulation pump 525 is connected to motor 17 by means of pulley 18 in such a manner that circulation pump 525 can receive the rotational force from motor 17.

The operation of the conventional washing machine being constructed as described above is as follows.

Firstly, when a user pushes an operating button installed on control panel 11, the washing liquid is introduced from the liquid source into a space 517 formed between removable lid 515 and guide member 514 by way of a washing water feed pipe 519 and adapter 520.

Then, the washing liquid that has been introduced into space 517 is sprinkled into the spin tub 512 through discharge silt 513 of guide member 514 and sprinkle nozzle 518 until a predetermined liquid level in spin tub 512 is achieved.

When the predetermined liquid level in spin tub 512 is achieved, a liquid feed control valve 530 blocks liquid feed pipe 519 and, at the same time, motor 17 rotates in the forward direction. The rotational force of motor 17 is transmitted to agitator 548 by way of belt 18, rotating shaft 542 of power transmission 540, gear and link assembly 544 and connection member 546 so that agitator 548 rotates in the forward and reverse directions, thereby washing the clothes.

At the same time, the forward directional drive force of drive motor 17 is also transmitted to circulation pump 525 through belt 18 so that circulation pump 525 rotates in the forward direction during the washing cycle. Therefore, the washing liquid that has been introduced into outer tub 15 is discharged from outer tub 15 into circulation pump 525 through a discharge port 526 formed at the bottom wall of outer tub 15.

Upon receiving the washing liquid, circulation pump 525 compresses the washing water and draws the washing water up to adapter 520 through circulation tube 521. Then, the compressed washing water is introduced into space 517 and sprinkled to the clothing loaded in spin tub 512 through discharge slit 513 and sprinkling nozzle 518.

When the washing cycle has finished, the washing water filled in outer tub 15 is drained into the exterior of washing machine 500 through draining tube 533. At this time, motor 17 rotates in the reversed direction so as to rotate spin tub 512. As spin tub 512 rotates, the clothing loaded in spin tub 512 is subjected to centrifugal force so that the clothing is forced radially outward (i.e., toward the side wall of spin tub 512) and thereby washing liquid contained in the clothing is drained through a plurality of through holes 452 formed in the side wall of spin tub 512.

On the other hand, when motor 17 rotates in the reverse direction, circulation pump 525 connected to motor 17 also rotates in the reverse direction so that the washing liquid discharged from a plurality of through holes 452 is drained into the exterior of the washing machine 500 through circulation pump 525.

However, the conventional washing machine constructed as described above has the following disadvantages.

Firstly, the washing machine sprays the washing liquid through the sprinkling nozzle having a relatively small size so that it takes much time to spray a predetermined mount of the washing liquid into the outer tub.

Further, since the sprinkling nozzle is only formed at one spot of the outer tub, the washing machine does not evenly spray the washing liquid onto the clothing when the clothing is fully loaded in the spin tub.

Furthermore, the washing machine does not completely remove impurities such as foam formed between the outer tub and the spin tub when the impurities are formed at a place opposite to the sprinkling nozzle. The impurities formed between the outer tub and the spin tub interfere with the rotation of the spin tub, thereby causing energy loss.

Accordingly, there has been a necessity to provide a washing machine which not only sprays the circulated washing liquid onto the clothing evenly, but also completely removes the impurities formed between the outer tub and the spin tub, thereby improving the operating efficiency.

SUMMARY OF THE INVENTION

The present invention has been made to overcome the above described problems of the prior arts, and accordingly it is an object of the present invention to provide a washing machine which not only sprays the circulated washing liquid onto the clothing evenly, but also completely removes the impurities formed between the outer tub and the spin tub.

To achieve the above object, the present invention provides a washing machine comprising:

a housing having a control board at its upper portion;

an outer tub disposed in the housing so as to receive a washing liquid;

a spin tub accommodated in the outer tub, the spin tub having a plurality of discharging holes at its side wall and being driven by a motor;

a spraying nozzle assembly for spraying the washing liquid into clothes loaded in the spin tub; and a circulation pump disposed at a lower portion of the housing and communicated with the outer tub so as to circulate the washing liquid into the spraying means through a circulation tube or to drain the washing liquid into an exterior of the washing machine through a draining tube, wherein the spraying nozzle assembly is mounted on an upper portion of the outer tub so as to evenly spray the circulated washing liquid into the clothes, the spraying nozzle assembly spraying some of the circulated washing liquid toward an upper inner wall of the outer tub.

According to a preferred embodiment of the present invention, the spraying nozzle assembly includes an upper frame and a lower frame having a plurality of spraying nozzles at its underside. The lower frame is welded to the upper frame.

The spraying nozzle assembly is mounted on an upper portion of the outer tub so as to evenly spray the circulated washing liquid onto the clothes and so as to spray some of the circulated washing liquid toward an upper inner wall of the outer tub.

The upper frame has an annular shape and is integrally formed with an upper knob extended in a transverse direction. The lower frame has an annular shape in correspondence to the upper frame and is integrally formed with a lower knob extended in a transverse direction. The upper frame is provided at its underside with a first annular ridge portion formed around a circumference of the upper frame, a second annular ridge portion radially spaced inward apart from the first annular ridge portion and a third annular ridge portion radially spaced inward apart from the second annular ridge portion. The lower frame is provided at its upper surface with a first annular strip portion formed around a circumference of the lower frame, a second annular strip portion radially spaced inward apart from the first annular strip portion and a third annular strip portion radially spaced inward apart from the second annular strip portion. The first, second and third annular ridge portions are extended downwards and the first, second and third annular strip portions are extended upwards so as to be in contact with the first, second and the third annular ridge portions respectively. The second annular ridge portion has an upper guide portion extended in a transverse direction at a predetermined length and the second annular strip portion has a lower guide portion extended in a transverse direction at a predetermined length. The upper guide portion and the lower guide portion cooperate with each other so as to guide the circulated washing liquid into the spraying nozzle assembly. The lower guide portion has a distal end extended downwards so as to communicate with the circulation tube. The distal end is provided with a fluid inlet hole. The upper frame has an upper annular groove formed between the first annular ridge portion and the second annular ridge portion and an upper annular recess formed between the second annular ridge portion and the third annular ridge portion. The lower frame has a lower annular groove formed between the first annular strip portion and the second annular strip portion and a lower annular recess formed between the second annular strip portion and the third annular strip portion. The upper annular groove cooperates with the lower annular groove so as to form a first space for reducing a vibration and the upper annular recess cooperates with the lower annular recess so as to form a second space for receiving the circulated washing liquid. The upper annular recess has a plurality of slots being spaced at a predetermined length in a circumferential direction from each other. The lower frame is integrally formed around its circumference with a support member so as to permit the lower frame to be secured on an upper surface of the outer tub. The support member has a shoulder in contact with the upper surface of the outer tub and a cylindrical base inserted in an opening of the outer tub. Each of the first, second and third annular ridge portions is welded to the first, second and third annular strip portions, respectively. The upper annular recess is provided at its upper wall with a first and second pin holes and the lower annular recess is provided at its bottom wall with a first and second pins. The first pin hole is disposed in opposition to the second pin hole and the first and second pins are disposed in correspondence with the first and second pin holes so as to be inserted in the first and second pin holes, respectively.

Each spraying nozzle has a spraying hole communicated with the lower annular recess. Each spraying nozzle is circumferentially spaced apart from each other at a predetermined length and extended downward from the underside of the lower frame at a predetermined length so as to guide the circulated washing water onto the clothing.

According to another embodiment of the present invention, the spraying nozzle extends toward the inner wall of the spin tub. In this case, the circulated washing liquid is sprayed to the upper inner wall of the spin tub.

The washing machine being constructed as described above according to the present invention is operated as follows.

Firstly, when a user pushes an operating button installed on a control panel, the washing liquid is introduced from the liquid source into the outer tub through a washing liquid feeding chamber.

Then, when the predetermined liquid level in the outer tub is achieved, the motor rotates in the forward and reverse directions. The rotational force of the motor is transmitted to the pulsator through a gear assembly so that the pulsator rotates in the forward and reverse directions, thereby washing the clothes.

At the same time, the circulation pump operates so that some of the washing liquid is circulated into the spraying nozzle assembly mounted on the upper portion of the outer tub through the circulation tube.

Then, the washing liquid introduced into the spraying nozzle assembly flows into the spraying nozzles. The washing liquid is then sprinkled to the clothing loaded in the spin tub.

At this time, since each of spraying nozzles alternately extend toward the inner wall of the spin tub, foam formed between the spin tub and the outer tub can be removed during the washing cycle.

In the washing machine of the present invention, the washing liquid repeats the circulation and the spraying nozzle assembly sprays the circulated washing liquid onto the clothing strongly so that washing effect is improved without causing waste of the washing liquid.

When the washing cycle has finished, the motor rotates in the forward direction so that the spin tub rotates in the forward direction. As the spin tub rotates, the clothing loaded in the spin tub is subjected to centrifugal force so that the clothing is forced toward the side wall of the spin tub and thereby washing liquid contained in the clothing is discharged through a plurality of discharging holes formed in the side wall of the spin tub.

During the dehydrating cycle, same as with the washing cycle, the washing liquid is sprayed onto the clothing through the spraying nozzle assembly. Since the washing machine sprays the compressed washing liquid onto the clothing during dehydrating cycle, impurities contained in the clothing are effectively removed as compared with the conventional washing machine.

As described above, the washing machine of the present invention can evenly spray the circulated washing liquid onto the clothing through the spraying nozzle assembly mounted on the upper portion of the outer tub so that washing effect can be improved without causing waste of the washing liquid.

BRIEF DESCRIPTION OF THE DRAWINGS

The above objects and other advantages of the present invention will become more apparent by describing in detail preferred embodiments thereof with reference to the attached drawings, in which.

DESCRIPTION OF THE PREFERRED EMBODIMENTS

Hereinafter, the present invention will be described in detail with reference to the accompanying drawings.

Figure 1:
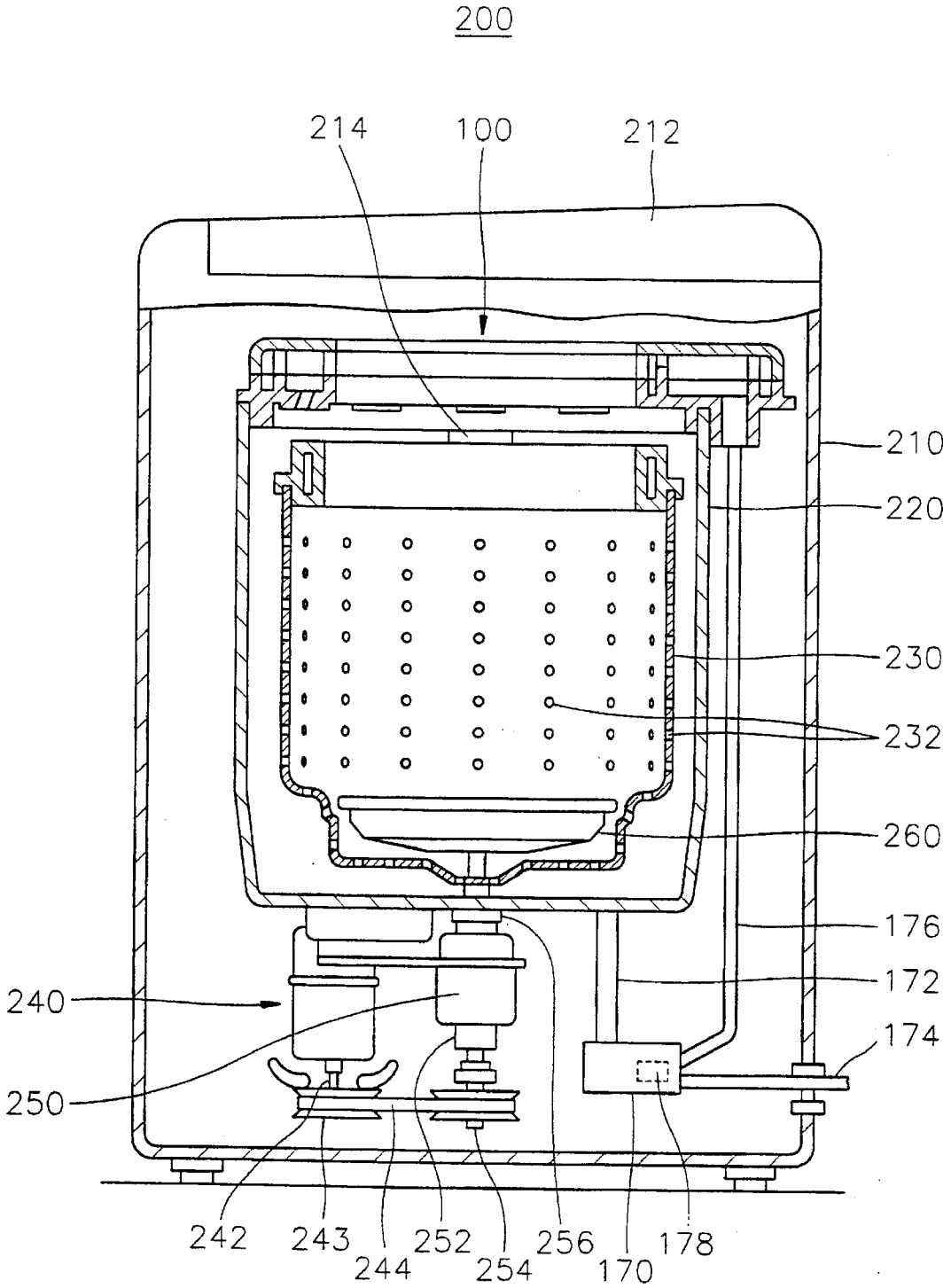
FIG. 1 is a sectional view for showing the structure of a washing machine according to one embodiment of the present invention.

FIG. 1 shows a washing machine 200 according to one embodiment of the present invention.

As shown in FIG. 1, washing machine 200 has a housing 210, an outer tub 220 disposed in housing 210 so as to receive the washing liquid, a spin tub 230 accommodated in outer tub 220 and formed at its side wall with a plurality of discharging holes 232, a main motor 240 generating a rotational force for operating washing machine 200, a gear assembly 250 receiving the rotational force from main motor 240 then transmitting the rotational force to spin tub 230 or to a pulsator 260 mounted on the bottom wall of spin tub 230 alternatively, a spraying nozzle assembly 100 mounted on the upper portion of outer tub 220 so as to spray the washing liquid onto the clothing and a circulation pump 170 disposed at the lower portion of housing 210 and communicated with outer tub 220 so as to circulate the washing liquid into spraying nozzle assembly 100 to or to drain the washing liquid into the exterior of washing machine 200 through a drain tube 174.

Housing 210 has a control board(not shown) for selecting operating modes at its upper portion. A cover is hinged to the upper end of housing 210.

Outer tub 220 is formed at its upper inner wall with a washing water feeding chamber 214 for supplying the washing liquid into outer tub 220 as washing machine 200 operates.

In addition, a detergent bucket(not shown) is inserted in washing liquid feeding chamber 214 so that the washing liquid mixed with the detergent is supplied into outer tub 220.

Main motor 240 has a motor shaft 242 formed at its lower end with a first pulley 243. Gear assembly 250 has a rotating shaft 252 formed at its lower end with a second pulley 254. Second pulley 254 is connected to first pulley 243 through a belt 244 in such a manner that the rotational force of main motor 240 can be transmitted to gear assembly 250.

Between gear assembly 250 and pulsator 260, there is disposed a connection member 256. Connection member 260 transmits the rotational force from main motor 240 to spin tub 230 or to pulsator 260, alternatively.

On the other hand, circulation pump 170 has a reversible pump motor 178 therein and is connected to outer tub 220 through a discharging tube 172. In addition, circulation pump 170 is connected to spraying nozzle assembly 100 through a circulation tube 176.

Figure 2:
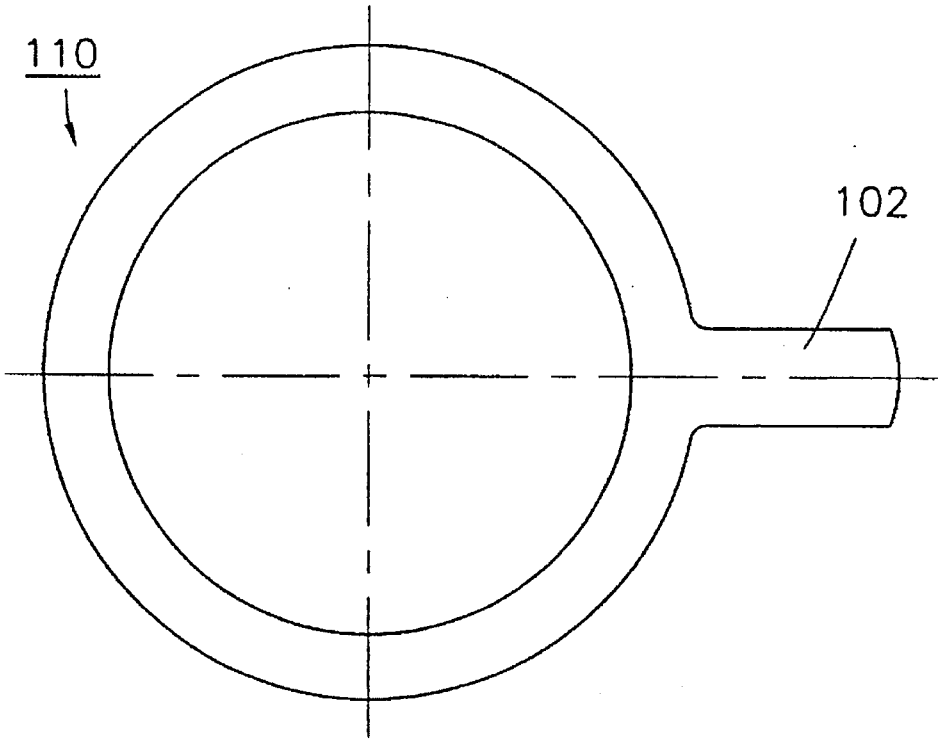
FIG. 2 is a plan view for showing an upper frame of a spraying nozzle assembly as shown in FIG. 1.
Figure 3:
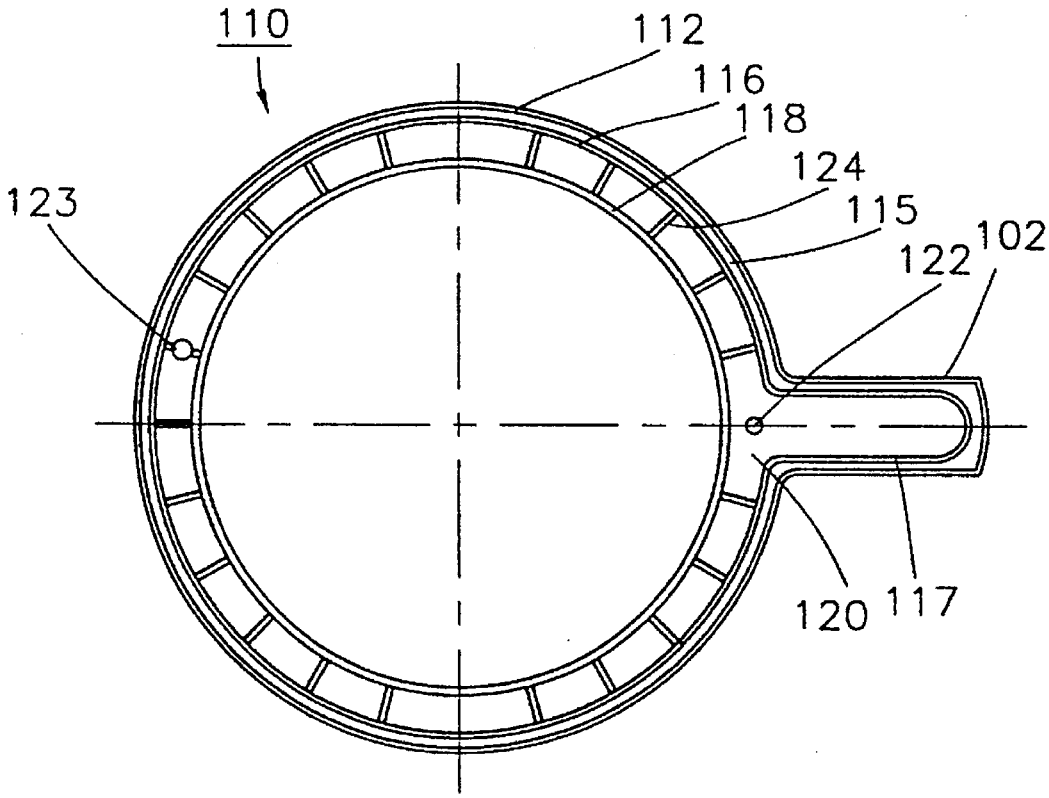
FIG. 3 is a bottom view of the upper frame as shown in FIG. 2.

As shown in FIGS. 2 to 5, spraying nozzle assembly 100 has an upper frame 110 and a lower frame 130 welded to upper frame 110 by a well known method such as a fusion welding:

FIGS. 2, and 3 show the top and bottom views of upper frame 110 of spraying nozzle assembly 100, respectively.

Upper frame 110 has an annular shape and is formed integrally with an upper knob 102 extended in the transverse direction.

Upper frame 110 is provided at its underside with a first annular ridge portion 112 formed around the circumference of upper frame 110 and extended downwards therefrom, a second annular ridge portion 116 radially spaced inward apart from first annular ridge portion 112 and extended downwards therefrom and a third annular ridge portion 118 radially spaced inward apart from second annular ridge portion 116 and extended downwards therefrom.

Accordingly, an upper annular groove 115 is formed between first annular ridge portion 112 and second annular ridge portion 116 and an upper annular recess 120 is formed between second annular ridge portion 116 and third annular ridge portion 118.

A part of first annular ridge portion 112 extends in the transverse direction along with upper knob 102. In addition, second annular ridge portion 116 has an upper guide portion 117 extended in the transverse direction at a predetermined length so as to guide the washing liquid from circulation tube 176 into spraying nozzle assembly 100.

Upper annular recess 120 has a plurality of slots 124, each slot 124 is spaced in the circumferential direction from each other so as to improve durability of upper frame 110, and a first and second pin holes 122 and 123 for coupling lower frame 130 to upper frame 110 at its upper wall. First pin hole 122 is disposed in opposition to second pin hole 123.

Figure 4:
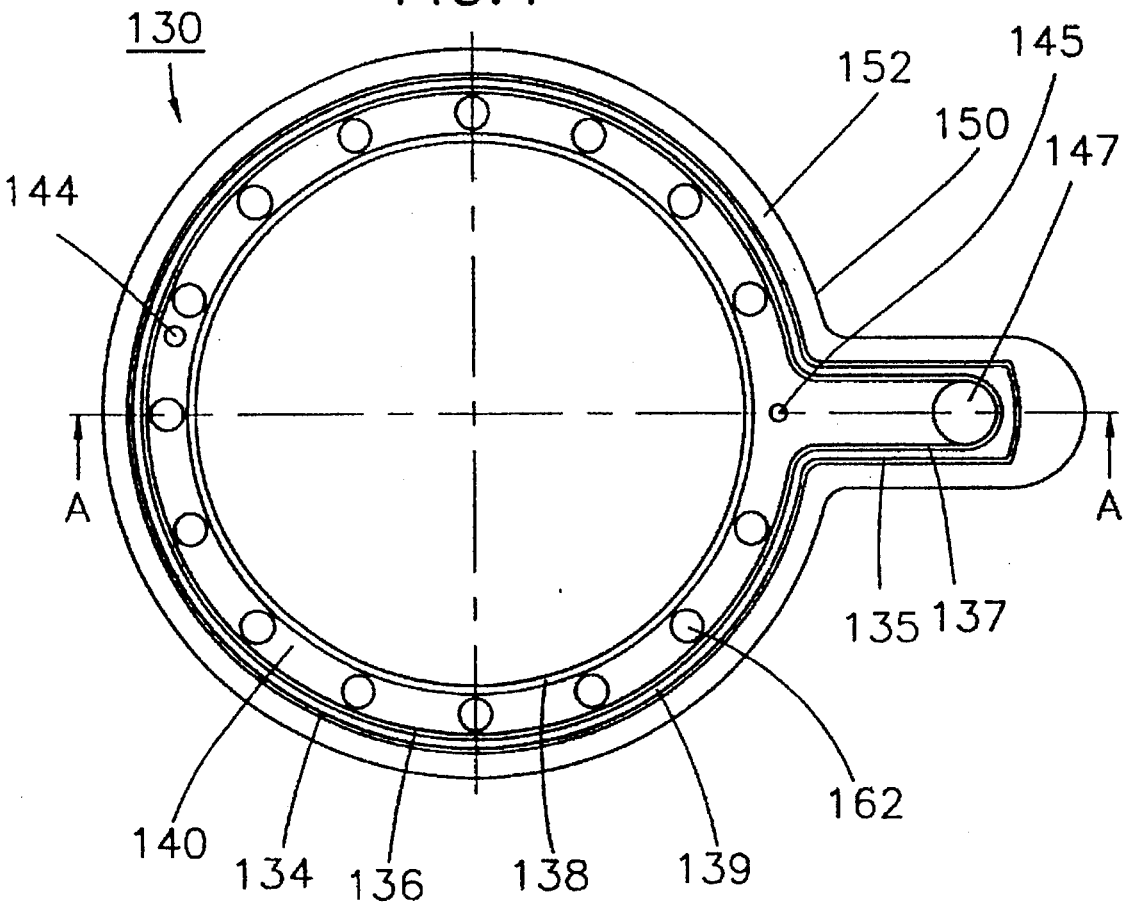
FIG. 4 is a plan view for showing a lower frame of the spraying nozzle assembly as shown in FIG. 1.
Figure 5:
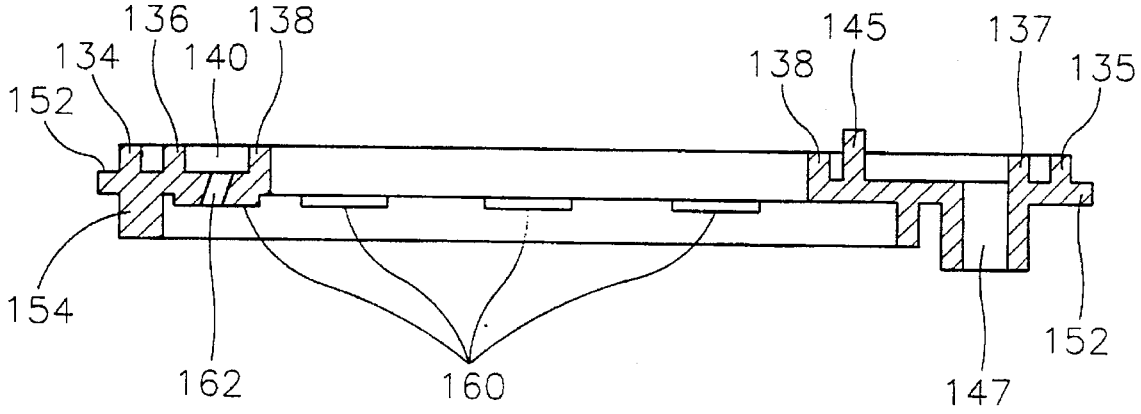
FIG. 5 is a sectional view of the upper frame taken along line A—A of FIG. 4.
Figure 6:
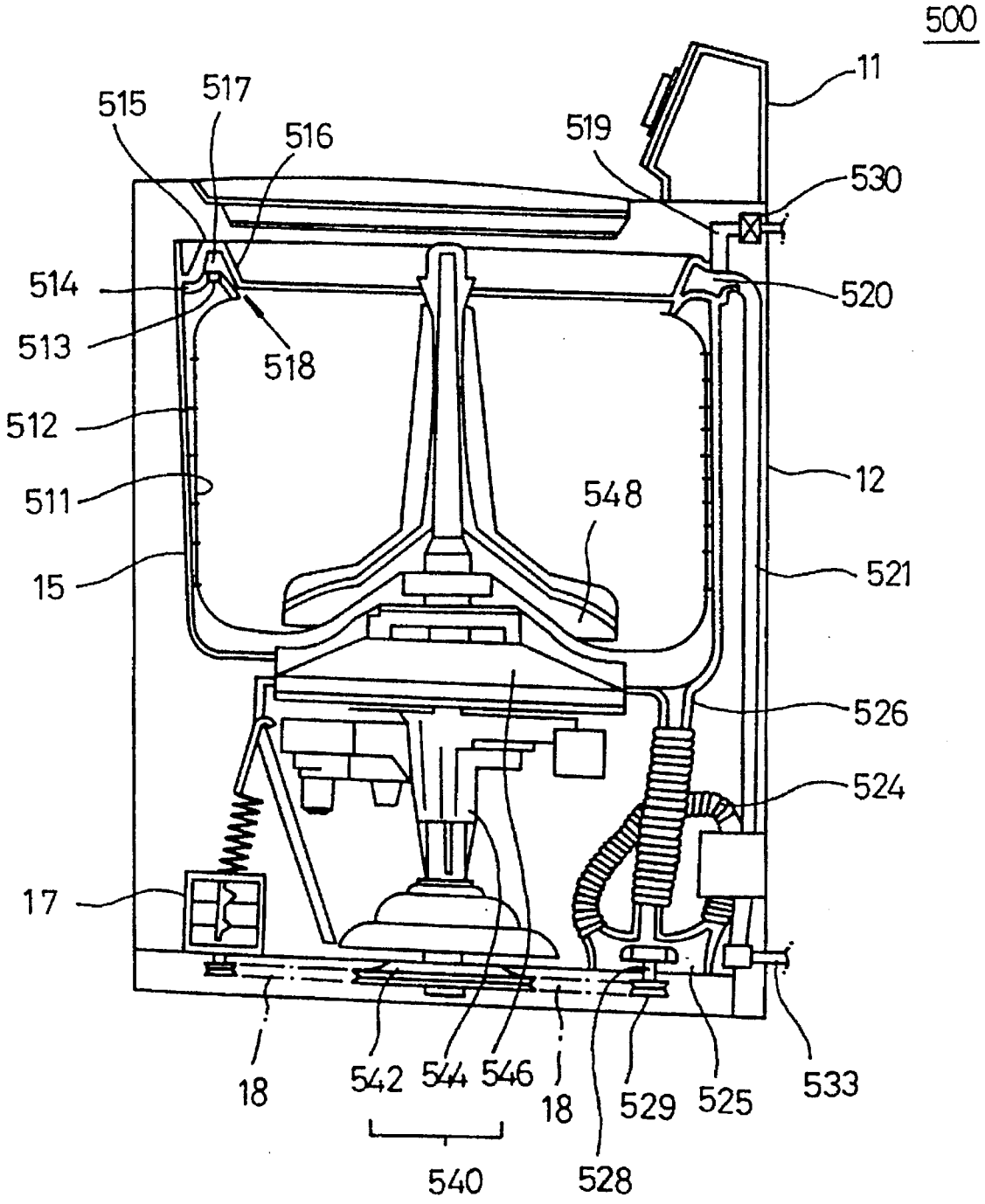
FIG. 6 (PRIOR ART)
FIG. 6 is a sectional view of a conventional washing machine.

Referring to FIGS. 4 and 5, lower frame 130 also has an annular shape in correspondence to upper frame 110 and is integrally formed with a lower knob 135 extended in the, transverse direction.

In addition, a support member 150 for supporting lower frame 130 is integrally formed around the circumference of lower frame 130. Support member 150 includes a shoulder 152 which is in contact with the upper surface of outer tub 220 so as to maintain lower frame 130 at the upper portion of outer tub 220 and a cylindrical base 154 which is inserted in an opening of outer tub 220 so as to lead the washing liquid being sprayed into spin tub 230. Shoulder 152 of support member 150 can be fixed to the upper surface of outer tub 220 by means of bolts.

Lower frame 130 is provided at its upper surface with a first annular strip portion 134 formed around the circumference of lower frame 130 and extended upwards therefrom so as to be in contact with first annular ridge portion 112 of upper frame 110, a second annular strip portion 136 radially spaced inward apart from first annular strip portion 134 and extended upwards therefrom so as to be in contact with second annular ridge portion 116 of upper frame 110 and a third annular strip portion 138 radially spaced inward apart from second annular strip portion 136 and extended upwards therefrom so as to be in contact with third annular ridge portion 118 of upper frame 110.

Accordingly, a lower annular groove 139 is formed between first annular strip portion 134 and second annular strip portion 136 and a lower annular recess 140 is formed between second annular strip portion 136 and third annular strip portion 138.

Same as with upper frame 110, a part of first annular strip portion 134 extends in the transverse direction along with lower knob 135. In addition, second annular strip portion 136 has a lower guide portion 137 extended in the transverse direction at a predetermined length so as to guide the washing liquid from circulation tube 176 into spraying nozzle assembly 100. A distal end of lower guide portion 137 extends downwards so as to communicate with circulation tube 176 and is formed with a fluid inlet hole 147.

Each of first, second and third annular ridge portions 112, 116 and 118 is welded to first, second and third annular strip portions 134, 136 and 138 of upper frame 110 respectively by a well known method such as fusion welding.

When upper frame 110 is welded to lower frame 130, upper annular groove 115 is cooperated with lower annular groove 139 so as to form a first space in spraying nozzle assembly 100 and upper annular recess 120 is cooperated with lower annular recess 140 so as to form a second space in spraying nozzle assembly 100.

While washing machine 200 operates, the first space reduces the vibration of spraying nozzle assembly 100 caused by a fluctuation of the washing liquid and the second space receives the washing liquid from circulation tube 176.

On the other hand, lower annular recess 140 has a first and second pins 144 and 145 at its bottom wall. First and second pins 144 and 145 are disposed in correspondence with first and second pin holes 122 and 123 and inserted in first and second pin holes 122 and 123, respectively.

In addition, lower frame 130 has a plurality of spraying nozzles 160 at its underside for spraying the circulated washing water onto the clothing. Each of spraying nozzles 160 is circumferentially spaced apart from each other so as to evenly spray the circulated washing liquid onto the clothing.

Spraying nozzle 160 has a spraying hole 162 communicated with lower annular recess 140 and extends at a predetermined length downward from the underside of lower frame 130, thereby guiding the circulated washing water onto the clothing.

According to other embodiment of the present invention, each spraying nozzle extends toward the inner wall of spin tub 230. In this case, the circulated washing liquid is sprayed to the upper inner wall of spin tub 230 so that impurities such as foam formed between spin tub 230 and outer tub 220 can be completely removed.

In addition, according to another embodiment of the present invention, each spraying nozzle alternately extends toward the inner wall of spin tub 230. In this case, the circulated washing liquid is sprayed not only to the upper inner wall of spin tub 230 but also to the clothing loaded in spin tub 230 so that foam formed between spin tub 230 and outer tub 220 can be removed and the washing effect can be improved.

Washing machine 200 being constructed as described above according to the present invention is operated as follows.

Firstly, when a user pushes an operating button installed on a control panel, the washing liquid is introduced from the liquid source into outer tub 220 through washing liquid feeding chamber 214. As mentioned above, since the detergent bucket is inserted in washing liquid feeding chamber 214, the washing liquid mixed with the detergent is supplied into outer tub 220.

Then, when the predetermined liquid level in outer tub 220 is achieved, a liquid feed control valve (not shown) blocks liquid feeding chamber 214 and, at the same time, main motor 240 rotates in the forward and reverse directions. The rotational force of main motor 240 is transmitted to pulsator 260 by way of motor shaft 242, first pulley 243, belt 244, second pulley 254, gear assembly 250 and connection member 256 so that pulsator 260 rotates in the forward and reverse directions, thereby washing the clothes.

At the same time, an operating signal is transmitted to pump motor 178 accommodated in circulation pump 170 in accordance with a predetermined algorithm so that pump motor 178 is driven. The driving force of pump motor 178 is transmitted to circulation pump 170 so that some of the washing liquid that has been introduced into outer tub 220 is discharged from outer tub 220 into circulation pump 170 through discharging tube 172.

Upon receiving the washing liquid, circulation pump 170 compresses the washing liquid and circulates the washing liquid into spraying nozzle assembly 100 mounted on the upper portion of outer tub 220 through circulation tube 176.

That is, the compressed washing liquid flows into the second space of spraying nozzle assembly 100, which is formed by upper and lower annular recesses 120 and 140, through fluid inlet hole 147 communicated with circulation tube 176 and lower guide portion 137.

At this time, the first space formed by upper and lower annular grooves 115 and 139 reduces the vibration of spraying nozzle assembly 100 caused by the fluctuation of the compressed washing liquid.

Then, the compressed washing liquid introduced into the second space flows along the circumference of the second space.

After that, the compressed washing liquid that has been introduced into spraying holes 162 is sprinkled to the clothing loaded in spin tub 230.

At this time, since each spraying nozzle 160 alternately extends toward the inner wall of spin tub 230, foam formed between spin tub 230 and outer tub 220 can be removed during the washing cycle. In addition, since each spraying nozzle 160 is evenly distributed in the circumferential direction, the compressed washing liquid can be evenly sprayed onto the clothing.

In washing machine 200 according to the present invention, while the washing cycle is being executed, the washing liquid repeats the circulation and spraying nozzle assembly 100 sprays the circulated washing liquid onto the clothing strongly so that washing effect is improved without wasting any washing liquid.

When the washing cycle has finished, the washing liquid filled in outer tub 220 is drained into the exterior of washing machine 200 through draining tube 174. However, some of the washing liquid remains in outer tub 220 for performing the rinsing and dehydrating cycles.

In this state, main motor 240 rotates in the forward direction and, at the same time, pump motor 178 is driven in accordance with the predetermined algorithm. At this time, the driving force of main motor 240 is only transmitted to spin tub 230 so that spin tub 230 rotates in the forward direction. As spin tub 230 rotates, the clothing loaded in spin tub 230 is subjected to centrifugal force so that the clothing is forced toward the side wall of spin tub 230 and thereby washing liquid contained in the clothing is discharged through a plurality of discharging holes 232 formed in the side wall of spin tub 230.

During the dehydrating cycle, same as with the washing cycle, the washing liquid discharged through discharging holes 232 is sucked into circulation pump 170 and then sprayed onto the clothing by way of circulation tube 176 and spraying nozzle assembly 100. Since washing machine 200 sprays the compressed washing liquid onto the clothing during dehydrating cycle, impurities contained in the clothing are effectively removed as compared with the conventional washing machine.

On the other hand, after the washing liquid has circulated two or three times, pump motor 178 is driven so as to drain the washing liquid into the exterior of washing machine 200.

When the washing liquid has been drained, a predetermined amount of a fresh washing liquid is supplied from the liquid source into outer tub 220. The fresh washing liquid is also circulated through circulation pump 170, circulation tube 176 and spraying nozzle assembly 100 two or three times, and then drained into the exterior of washing machine 200.

The fresh washing liquid is supplied two or three times and the supplied washing liquid circulates two or three times before it is drained into the exterior of washing machine 200 so that the dehydrating and rinsing effect can be improved without wasting any washing liquid.

As described above, the washing machine of the present invention can evenly spray the circulated washing liquid onto the clothing through the spraying nozzle assembly mounted on the upper portion of the outer tub so that the washing effect can be improved without wasting any washing liquid.

Further, since each spraying nozzle alternately extends toward the inner wall of the spin tub, foam formed between the spin tub and the outer tub can be completely removed during the washing and dehydrating cycles.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. A washing machine comprising:

a housing having a control board at an upper portion thereof;

an outer tub disposed in the housing so as to receive a washing liquid;

a spin tub accommodated in the outer tub, the spin tub having a plurality of discharging holes at a side wall thereof and being driven by a motor;

a spraying nozzle assembly for spraying the washing liquid into a washing object loaded in the spin tub; and a circulation pump disposed at a lower portion of the housing and communicated with the outer tub so as to circulate the washing liquid into the spraying nozzle assembly through a circulation tube or to drain the washing liquid into an exterior of the washing machine through a draining tube, wherein the spraying nozzle assembly is mounted on an upper portion of the outer tub so as to evenly spray the circulated washing liquid into the washing object, the spraying nozzle assembly spraying some of the circulated washing liquid toward an upper inner wall of the outer tub.

2. The washing machine as claimed in claim 1, wherein the spraying nozzle assembly has an upper frame and a lower frame secured to the upper frame, the lower frame having a plurality of spraying nozzles at an underside thereof for spraying the circulated washing liquid.

3. The washing machine as claimed in claim 2, wherein the upper frame has an annular shape and is integrally formed with an upper knob extended in a first transverse direction, and the lower frame has an annular shape in correspondence to the upper frame and is integrally formed with a lower knob extended in a second transverse direction.

4. The washing machine as claimed in claim 2, wherein the upper frame is provided at an underside thereof with a first annular ridge portion formed around a circumference of the upper frame, a second annular ridge portion radially spaced inward apart from the first annular ridge portion and a third annular ridge portion radially spaced inward apart from the second annular ridge portion, and the lower frame is provided at an upper surface thereof with a first annular strip portion formed around a circumference of the lower frame, a second annular strip portion radially spaced inward apart from the first annular strip portion and a third annular strip portion radially spaced inward apart from the second annular strip portion, the first, second and third annular ridge portions being extended downwards and the first, second and third annular strip portions being extended upwards so as to be in contact with the first, second and third annular ridge portions respectively.

5. The washing machine as claimed in claim 4, wherein the second annular ridge portion has an upper guide portion extended in a first transverse direction and the second annular strip portion has a lower guide portion extended in a second transverse direction, the upper guide portion and the lower guide portion cooperating with each other so as to guide the circulated washing liquid into the spraying nozzle assembly.

6. The washing machine as claimed in claim 5, wherein the lower guide portion has a distal end extended downwards so as to communicate with the circulation tube, the distal end being provided with a fluid inlet hole.

7. The washing machine as claimed in claim 4, wherein the upper frame has an upper annular groove formed between the first annular ridge portion and the second annular ridge portion and an upper annular recess formed between the second annular ridge portion and the third annular ridge portion, and the lower frame has a lower annular groove formed between the first annular strip portion and the second annular strip portion and a lower annular recess formed between the second annular strip portion and the third annular strip portion, the upper annular groove cooperating with the lower annular groove so as to form a first space for reducing a vibration, the upper annular recess being cooperated with the lower annular recess so as to form a second space for receiving the circulated washing liquid.

8. The washing machine as claimed in claim 7, wherein the upper annular recess has a plurality of slots, each of the slots being spaced in a circumferential direction from an adjacent slot.

9. The washing machine as claimed in claim 7, wherein the lower frame is integrally formed around a circumference thereof with a support member so as to permit the lower frame to be secured on an upper surface of the outer tub.

10. The washing machine as claimed in claim 9, wherein the support member includes a shoulder being in contact with the upper surface of the outer tub and a cylindrical base inserted in an opening of the outer tub.

11. The washing machine as claimed in claim 9, wherein each of the first, second and third annular ridge portions is welded to the first, second and third annular strip portion respectively by fusion welding.

12. The washing machine as claimed in claim 9, wherein the upper annular recess is provided at an upper wall thereof with a first and second pin holes, and the lower annular recess is provided at a bottom wall thereof with a first and second pins, the first pin hole being disposed in opposition to the second pin hole, the first and second pins being disposed in correspondence with the first and second pin holes so as to be inserted in the first and second pin holes, respectively.

13. The washing machine as claimed in claim 9, wherein each of the spraying nozzles has a spraying hole communicated with the lower annular recess and is circumferentially spaced apart from an adjacent spraying nozzle so as to evenly spray the circulated washing liquid onto the washing object.

14. The washing machine as claimed in claim 13, wherein each of the spraying nozzles extends downward from the underside of the lower frame so as to guide the circulated washing water onto the washing object.

15. The washing machine as claimed in claim 13, wherein each of the spraying nozzles extends toward the inner wall of the spin tub.

16. The washing machine as claimed in claim 13, wherein each of the spraying nozzles alternately extends toward the inner wall of the spin tub.

17. A washing machine comprising:

a housing having a control board at an upper portion thereof;

an outer tub disposed in the housing so as to receive a washing liquid;

a spin tub accommodated in the outer tub, the spin tub having a plurality of discharging holes at a side wall thereof and being driven by a motor;

a spraying nozzle assembly for spraying the washing liquid onto a washing object loaded in the spin tub; and a circulation pump disposed at a lower portion of the housing and communicated with the outer tub so as to circulate the washing liquid into the spraying nozzle assembly through a circulation tube or to drain the washing liquid into an exterior of the washing machine through a draining tube, wherein the spraying nozzle assembly includes an annular upper frame and an annular lower frame having a plurality of spraying nozzles at an underside thereof, the annular lower frame being welded to the annular upper frame, the spraying nozzle assembly being mounted on an upper portion of the outer tub so as to evenly spray the circulated washing liquid onto the washing object, the annular upper frame being integrally formed with an upper knob extended in a first transverse direction, the annular lower frame being integrally formed with a lower knob extended in a second transverse direction, the annular upper frame being provided at an under surface thereof with a first annular ridge portion formed around a circumference of the annular upper frame, a second annular ridge portion radially spaced inward apart from the first annular ridge portion and a third annular ridge portion radially spaced inward apart from the second annular ridge portion, the annular lower frame being provided at an upper surface thereof with a first annular strip portion formed around a circumference of the annular lower frame, a second annular strip portion radially spaced inward apart from the first annular strip portion and a third annular strip portion radially spaced inward apart from the second annular strip portion, the first, second and third annular ridge portions being extended downwards and the first, second and third annular strip portions being extended upwards so as to be in contact with the first, second and the third annular ridge portions respectively, the second annular ridge portion having an upper guide portion extended in a third transverse direction and the second annular strip portion having a lower guide portion extended in a fourth transverse direction, the upper guide portion and the lower guide portion cooperating with each other so as to guide the circulated washing liquid into the spraying nozzle assembly, the annular upper frame having an upper annular groove formed between the first annular ridge portion and the second annular ridge portion and an upper annular recess formed between the second annular ridge portion and the third annular ridge portion, the annular lower frame having a lower annular groove formed between the first annular strip portion and the second annular strip portion and a lower annular recess formed between the second annular strip portion and the third annular strip portion, the upper annular groove cooperating with the lower annular groove so as to form a first space for reducing a vibration, the upper annular recess cooperating with the lower annular recess so as to form a second space for receiving the circulated washing liquid, the lower annular frame being integrally formed around a circumference thereof with a support member so as to permit the annular lower frame to be secured on an upper surface of the outer tub.

18. A washing machine comprising:

a housing having a control board at an upper portion thereof;

an outer tub disposed in the housing so as to receive a washing liquid;

a spin tub accommodated in the outer tub, the spin tub having a plurality of discharging holes at a side wall thereof and being driven by a motor;

a spraying nozzle assembly for spraying the washing liquid onto a washing object loaded in the spin tub; and a circulation pump disposed at a lower portion of the housing and communicated with the outer tub so as to circulate the washing liquid into the spraying nozzle assembly through a circulation tube or to drain the washing liquid into an exterior of the washing machine through a draining tube, wherein the spraying nozzle assembly includes an upper frame and a lower frame having a plurality of spraying nozzles at an underside thereof, the lower frame being welded to the upper frame, the spraying nozzle assembly being mounted on an upper portion of the outer tub so as to evenly spray the circulated washing liquid onto the washing object and so as to spray some of the circulated washing liquid toward an upper inner wall of the outer tub, the upper frame having an annular shape and being integrally formed with an upper knob extended in a first transverse direction, the lower frame having an annular shape in correspondence to the upper frame and being integrally formed with a lower knob extended in a second transverse direction, the upper frame being provided at an under surface thereof with a first annular ridge portion formed around a circumference of the upper frame, a second annular ridge portion radially spaced inward apart from the first annular ridge portion and a third annular ridge portion radially spaced inward apart from the second annular ridge portion, the lower frame being provided at an upper surface thereof with a first annular strip portion formed around a circumference of the lower frame, a second annular strip portion radially spaced inward apart from the first annular strip portion and a third annular strip portion radially spaced inward apart from the second annular strip portion, the first, second and third annular ridge portions being extended downwards and the first, second and third annular strip portions being extended upwards so as to be in contact with the first, second and the third annular ridge portions respectively, the second annular ridge portion having an upper guide portion extended in a third transverse direction and the second annular strip portion having a lower guide portion extended in a fourth transverse direction, the upper guide portion and the lower guide portion cooperating with each other so as to guide the circulated washing liquid into the spraying nozzle assembly, the lower guide portion having a distal end extended downwards so as to communicate with the circulation tube, the distal end being provided with a fluid inlet hole, the upper frame having an upper annular groove formed between the first annular ridge portion and the second annular ridge portion and an upper annular recess formed between the second annular ridge portion and the third annular ridge portion, the lower frame having a lower annular groove formed between the first annular strip portion and the second annular strip portion and a lower annular recess formed between the second annular strip portion and the third annular strip portion, the upper annular groove being cooperated with the lower annular groove so as to form a first space for reducing a vibration, the upper annular recess being cooperated with the lower annular recess so as to form a second space for receiving the circulated washing liquid, the upper annular recess having a plurality of slots, each slot being spaced in a circumferential direction from adjacent slot, the lower frame being integrally formed around a circumference thereof with a support member so as to permit the lower frame to be secured on an upper surface of the outer tub, the support member having a shoulder in contact with the upper surface of the outer tub and a cylindrical base inserted in an opening of the outer tub, each of the first, second and third annular ridge portions being welded to the first, second and third annular strip portions respectively, the upper annular recess being provided at the upper wall thereof with a first and second pin holes and the lower annular recess being provided at the bottom wall thereof with a first and second pins, the first pin hole being disposed in opposition to the second pin hole and the first and second pins being disposed in correspondence with the first and second pin holes so as to be inserted in the first and second pin holes respectively, each of the spraying nozzles having a spraying hole communicated with the lower annular recess, each of the spraying nozzles being circumferentially spaced apart from an adjacent spraying nozzle and being extended downward from the underside of the lower frame so as to guide the circulated washing water onto the washing object.

* * * * *